US006349874B1

(12) United States Patent
Hill

(10) Patent No.: US 6,349,874 B1
(45) Date of Patent: Feb. 26, 2002

(54) CARTON WITH INTEGRAL DISCRETE COMPARTMENT

(75) Inventor: Mark Hill, Sioux Falls, SD (US)

(73) Assignee: Bell Paper Inc., Sioux Falls, SD (US)

( * ) Notice: Subject to any disclaimer, the term of this patent is extended or adjusted under 35 U.S.C. 154(b) by 0 days.

(21) Appl. No.: 09/793,469

(22) Filed: Feb. 27, 2001

(51) Int. Cl.[7] ..... B65D 5/486

(52) U.S. Cl. ..... 229/120.18; 229/400; 229/405; 229/904

(58) Field of Search ..... 229/120.18, 400, 229/405, 902, 904, 906; 206/541; 426/119, 120

(56) References Cited

U.S. PATENT DOCUMENTS 3,442,435 A * 5/1969 Ludder et al. ..... 229/904
4,126,261 A * 11/1978 Cook ..... 229/904
4,955,528 A * 9/1990 Schluckebier ..... 229/902
5,137,210 A * 8/1992 Hibbs ..... 229/120.18
5,540,333 A * 7/1996 Gonzalez et al. ..... 229/904
5,720,429 A * 2/1998 Cordle ..... 229/120.18
5,875,957 A * 3/1999 Yocum ..... 229/906
6,102,208 A * 8/2000 Huang ..... 229/120.18
6,119,930 A * 9/2000 Lunstra et al. ..... 229/400

* cited by examiner

*Primary Examiner*—Gary E. Elkins
(74) *Attorney, Agent, or Firm*—Gipple & Hale

(57) ABSTRACT

A carton for co-packaging two distinct food substances in two distinct cavities within the carton. The carton is formed of a single blank of paperboard creased, folded and glued to form one major cavity and one minor cavity, said minor cavity being an integral discrete compartment.

5 Claims, 3 Drawing Sheets

CARTON WITH INTEGRAL DISCRETE COMPARTMENT

The present invention is directed to a carton for co-packaging two distinct food substances, in two distinct cavities. This is accomplished by means of a single blank of paperboard which is creased, folded and glued so as to form one major cavity and one minor cavity, said minor cavity being an integral discrete compartment.

BACKGROUND OF THE INVENTION

At fast food restaurants and at take- out counters, french fries are often sold in paperboard cartons. Many people like to apply ketchup to french fries. If it is applied directly to the fries in the container, they will tend to become soggy. Alternatively, one can obtain a small separate container of ketchup, into which a french fly may be dipped immediately before it is eaten. But this latter gourmet preference has the disadvantage of requiring two separate containers. With the human limitation of two hands, there is one hand to hold the container of fries and one to move the fries from container to mouth. So a stable and convenient surface is required to support the ketchup. But, since fast food customers are often on the move, they want to carry the fries with them as they walk or ride. A solution to the problem is a container for the fries, which includes an integral, discrete compartment for the ketchup.

In Applicant's earlier U.S. Pat. No. 6,119,930, it disclosed a carton which addressed the problem described above. It disclosed a container for french fries, which had an integral, discrete compartment for ketchup. But it had some disadvantages and inconveniences.

One such drawback results from the manner in which the flat bottom of the carton (illustrated in FIG. 3, 4 and 5 of U.S. Pat. No. 6,119,930) is formed. It has four bottom panels, which are intricately die cut and scored, so as to interlock when the carton is formed. The intricate die cutting adds substantially to the cost of manufacturing the carton. Also, the relative complexity of the four interlocking bottom panels make it subject to malfunction. It should be understood, that in the context of its use (e.g. fast food restaurant or carry out), the server takes a flat, folded carton and snaps it into open position, before filling its compartments with french fries and ketchup. This is necessarily done as swiftly and smoothly as possible. If the bottom panels do not immediately and properly interlock, if the server has to manually adjust or push the bottom panels into proper alignment, that is a major drawback.

An equally serious drawback, is that the bottom formed by the four interlocking bottom panels is not entirely flat and is relatively small in diameter. This makes it somewhat tippy. And the problem is exacerbated by the fact that the ketchup in its upper compartment is dense and heavy. So the carton is top heavy and easily tipped.

The present invention addresses these problems by providing a container which has a bottom comprised of a single panel, scored in the middle. The server, when forming the carton simply pushes up on the bottom panel and it snaps into shape. There is no complicated interlocking of panels. There is little or no possibility of malfunction. Furthermore the present invention provides a carton with a bottom that has a leg portion on each end of extended rectangular bottom, that arches up and away from the leg portions. It is a very stable bottom for the carton, therefore the carton cannot be easily tipped.

A further drawback to the carton disclosed in applicant's earlier patent, is its configuration; its four wall panels extend upwardly from it relatively small rhomboid or square shaped bottom. It can contain only the smallest order of french fries. In the present invention the four wall panels extend upwardly from an elongated ovoidal bottom that has an area approximately twice that of carton disclosed in the earlier patent. Therefore, the volume of the container is twice as large, even though it is but slightly higher. Added height would increase tippiness.

To summarize, the principal advantages of the present invention are that it is less costly to produce (since it eliminates intricate die cuts on the bottom panels), it is less likely to malfunction when being snapped open by a user, it has a more stable bottom and is therefore less tippy, its upper discrete compartment is formed in such a manner that the volume of the container is greatly increased without substantial increase in height.

DETAILED DESCRIPTION OF THE INVENTION

In accordance with the present invention, a carton adapted for french fries, is formed from a single die-cut blank of paperboard, or similar material. The carton, as formed, includes on its inner periphery a discrete compartment adapted for holding a portion of some different food substance, such as ketchup.

The unique carton, including a integral and discrete compartment will be more fully appreciated and understood by having reference to the drawings which illustrate the preferred embodiment thereof.

Figure 1:
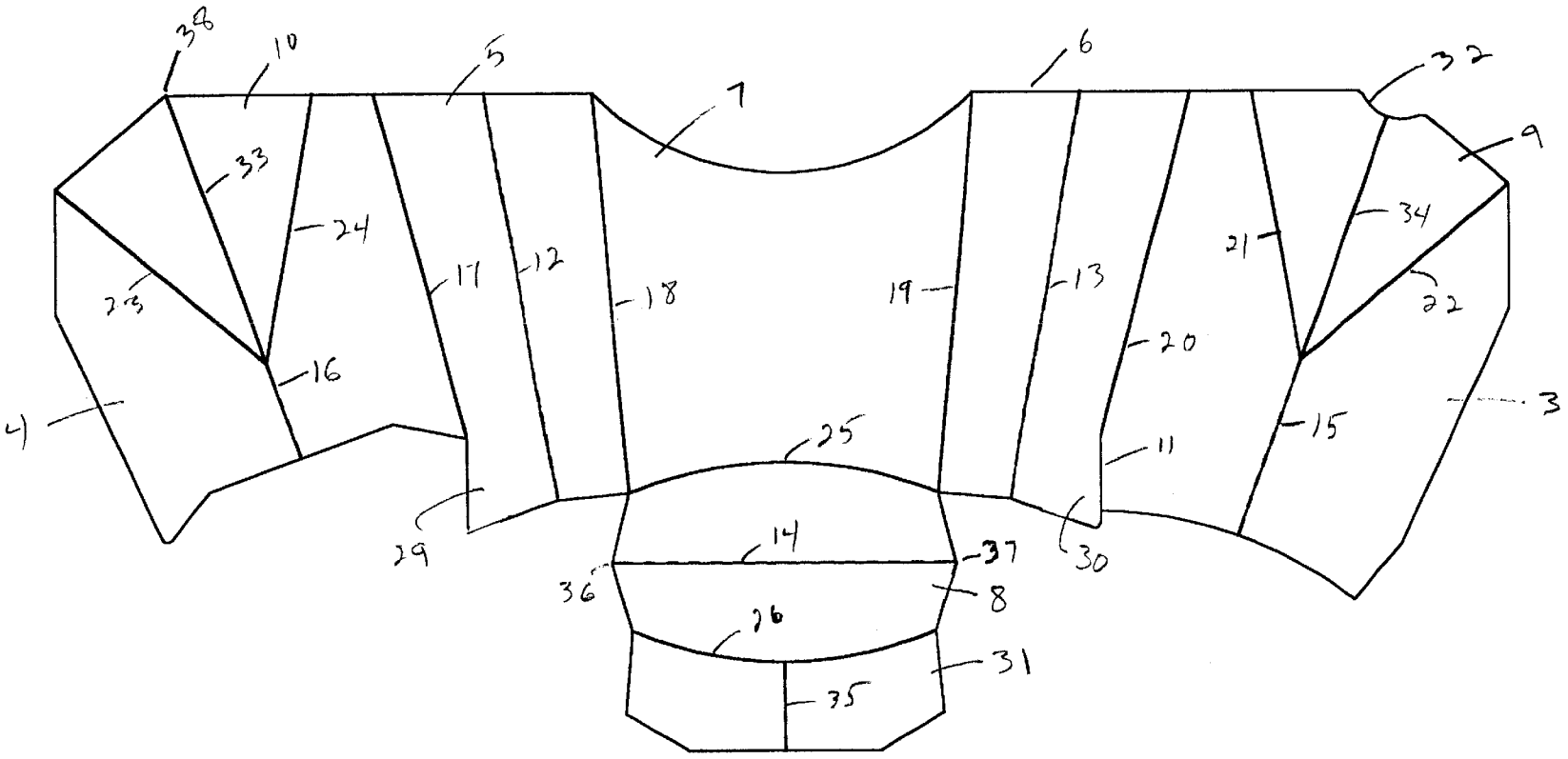
FIG. 1 illustrates a top plan view of the unfolded, die-cut blank.

Directing attention to FIG. 1 of the drawings, a blank is die cut out of paperboard. It is also die cut along line 11. It is creased for folding along lines 17, 18, 19 and 20. It is also creased along lines 25 and 26. It is semiperforated along lines 12, 13, 14, 15, 16 and 35. Crease 17 defines the inner back wall panel 4. Creases 20 and die cut 11 define the outer back wall panel 3. Front wall panel 7 extends between creases 18 and 19. Side wall panel 5 extends between creases 17 and 18. Side wall panel 6 extends between creases 19 and 20. Bottom panel 8, includes a bottom extending between creases 25 and 26;and contiguous therewith, a bottom tab 31. An upper portion of inner back wall panel 4 includes an inner compartment wall 10, defined between creases 23 and 24. An upper portion of outer back wall panel 3 includes an outer compartment wall 9, defined between creases 21 and 22.

Figure 2:
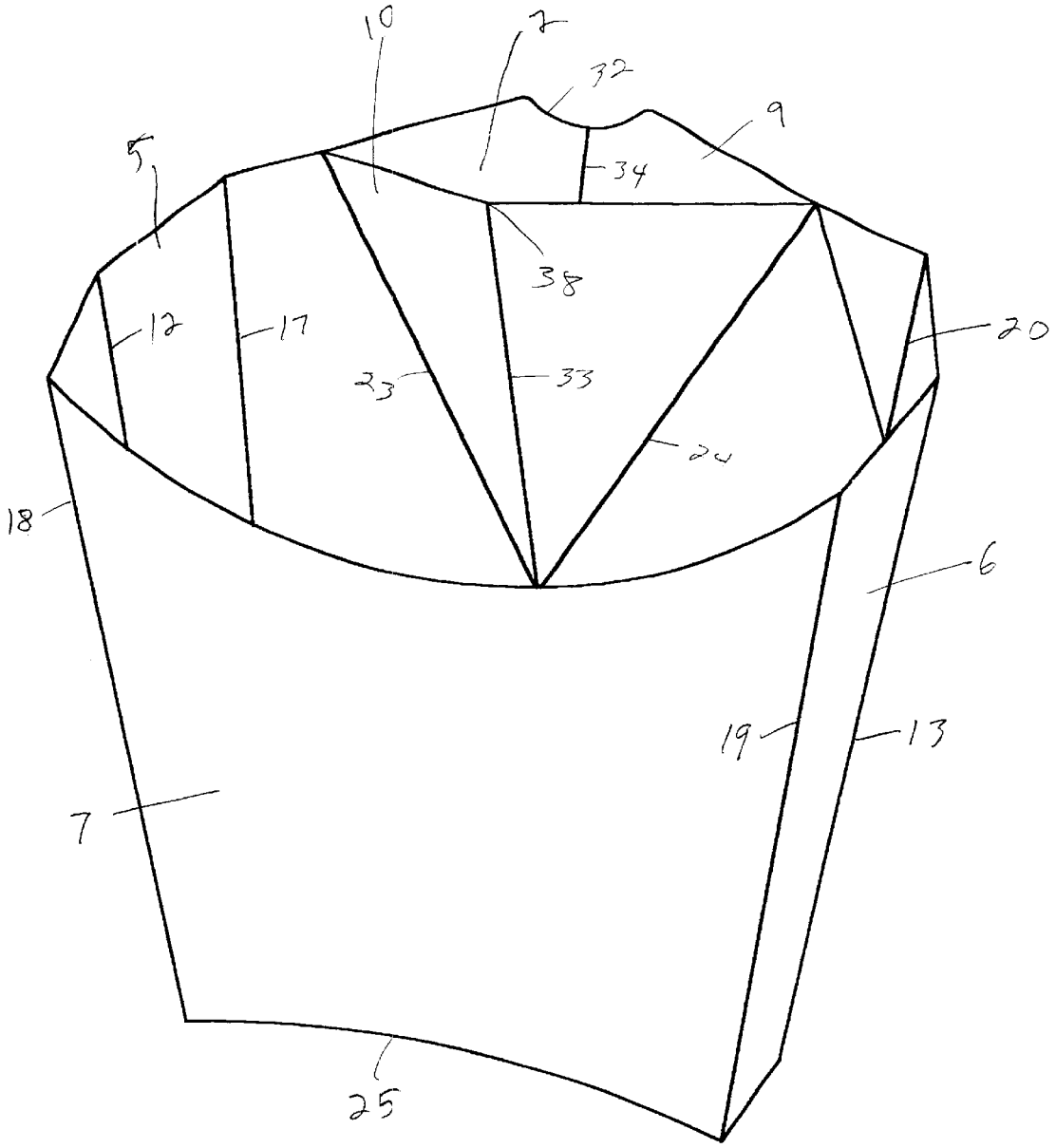
FIG. 2 illustrates a front a perspective view of the fully assembled carton.
Figure 3:
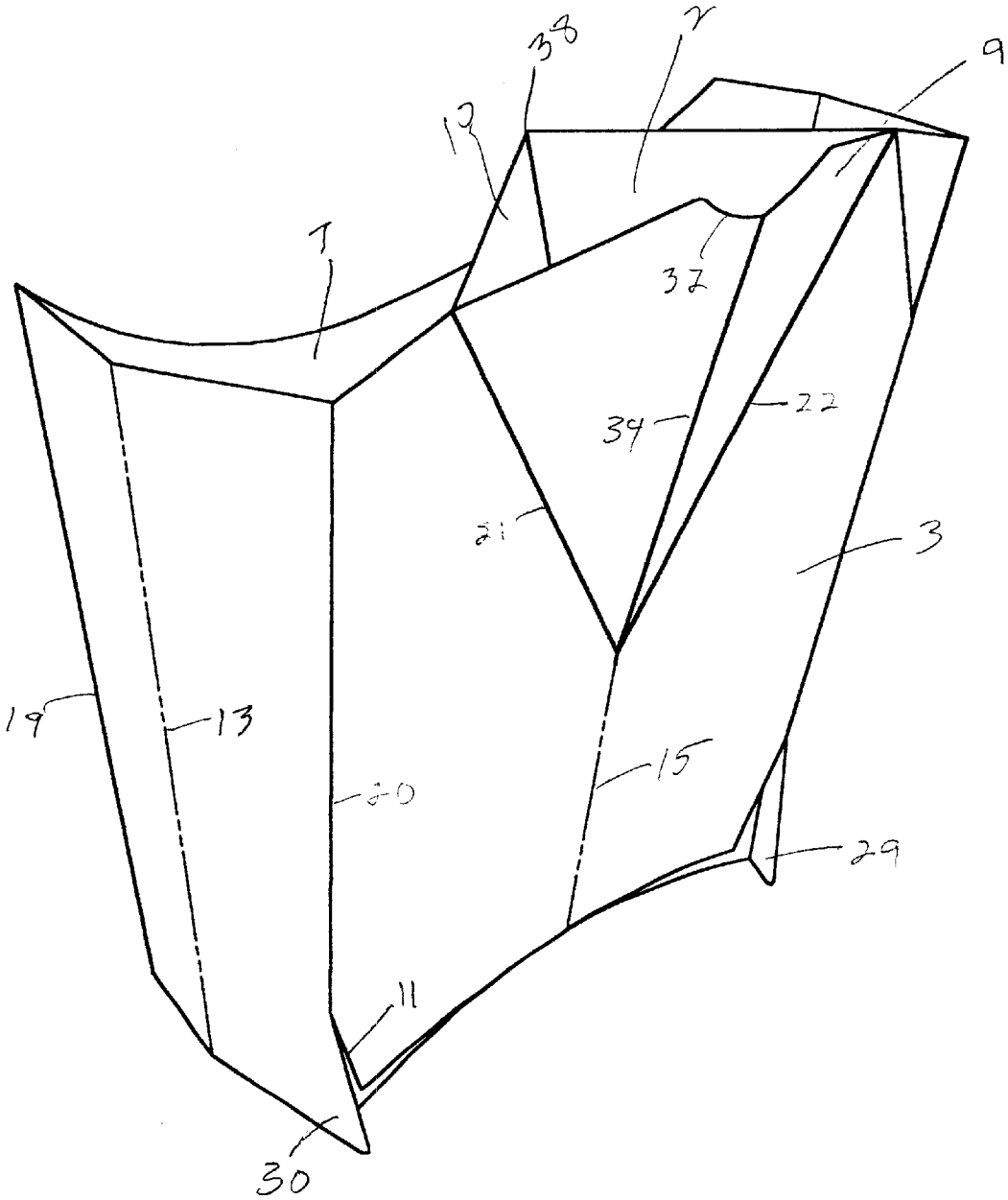
FIG. 3 illustrates a rear perspective view of the fully assembled carton.

Directing attention to FIG. 2 and FIG. 3 of the drawings, the carton is formed by folding inner back wall panel 4 under outer back wall panel 3 and secured by gluing. Bottom panel 8 is folded at crease 25 to a position perpendicular to wall panels 3, 4, 5, 6 and 7. Bottom tab 31 is folded at crease 26 to a position adjacent the bottom portion of outer back wall panel 3 and secured thereto by gluing.

It should be noted that the terminal end of bottom tab 31 has a configuration which corresponds to and fits tightly within the terminal end of inner back wall panel 4 which is also secured by gluing to outer back, wall panel 3, immediately above where bottom tab 31 is secured to outer back wall panel 3.

The semi-perforated line 35, divides bottom tab 31. When bottom tab 31 is positioned in the formed carton, the semi-perforated line 35 is immediately adjacent the semi-perforated line 15 of the outer back wall panel 3, and aligns with the semi-perforated line 16 of the inner back wall panel 4. This gives the entire back wall panel a greater flexibility to curve outwardly is correspondence to the outward curve of crease 26, when the bottom panel 8 is positioned in the formed carton. Similarly, the semi-perforated lines 12 and 13 provide greater flexibility to the side panels 5 and 6 in curving outwardly in correspondence to the outward extending peripheral points 36 and 37, at opposite ends of semi-perforated line 14 of the bottom panel 8.

The semi-perforated line 14 provides greater flexibility along the axis of bottom panel 8, allowing it to curve upwardly when the carton is formed.

An important aspect of the present invention is the configuration of bottom panel 8. It is essentially an elongated ovoid, having creases 25 and 26 which curve outwardly from the axis (semi-perforated line 14); and outwardly extending peripheral points 36 and 37 at opposite ends of the axis. When the assembled and glued blank is formed into a carton, the user presses up on the bottom panel 8 along the axis (semi-perforated line 14) and the panel 8 snaps into a upwardly arched position. The upwardly arched position assumed by the bottom panel 8 is dictated by the outward curve of creases 25 and 26. The elongated ovoid configuration of bottom panel 8 becomes the base for upward extending wall panels 3, 4, 5, 6 and 7, which collectively form the four sides of the carton. Each of the wall panels is tapered, being wider at top than at bottom. Therefore the top open end of the carton (in cross section) has the same elongated ovoid configuration as bottom panel 8, but has greater dimensions. So the overall shape of the carton might be described as an ovoid frustum.

Creases 21 and 22 define an outer compartment wall 9 in the upper portion of outer back wall panel 3. Outer compartment wall 9 has a crease 34 along its vertical axis. At the upper terminus of creases 34, there is a notch or fingerhole 32.

Creases 23 and 24 define an inner compartment wall 10 in the upper portion of inner back wall panel 4. Inner compartment wall 10 has a crease 33 along its vertical axis, and an upward extending peripheral point 38 at the upper terminus of crease 33.

When the carton is formed, panels 3 and 4 are glued together, but their contiguous compartment walls 9 and 10 are not glued together. So a user's finger can easily pass through the fingerhole 32 to engage the extending peripheral point 38 and snap open the integral discrete compartment 2. The creases 33 and 34 facilitate formation of the integral discrete compartment 2.

On the outer bottom end of side panel 6, a tab 30 is formed by die cut 11. When the carton is formed tab 30 extends back from and slightly below the arched bottom panel 8. A corresponding tab 29, is formed on the outer bottom end of side panel 8. A corresponding tab 29, is formed on the outer bottom end side panel 5. When the carton is formed tab 29 extends back from and slightly below the arched bottom panel 8. So, the opposite ends of creases 25 of bottom panel 8 align with tabs 29 and 30 to form a four point footing for the carton that is stable and relatively untippable.

Other modifications and expedients will be apparent to those of ordinary skill in the art and are considered to fall within the scope of the invention as defined by the claims appended thereto.

What is claimed is:

1. A carton for co-packaging two distinct food substances, said carton being formed from a single blank of paperboard creased so as to comprise two side wall panels, one front wall panel, and an outer wall panel formed by the panels on the opposite sides of the single blank being overlapped and glued to form one back wall panel of a four sided carton, each of the overlapped panels forming the back wall having unglued portions which can be spread apart to form an integral discrete compartment, said single blank also including a bottom panel of elongated ovoid configuration with a bottom tab which is glued to the bottom portion of adjacent wall panel.

2. The carton of claim 1, in which said side bottom panel has a semi-perforated line along its axis.

3. The carton of claim 1, in which said side panels have a semi-perforated line along their vertical axis.

4. The carton of claim 1, in which the outer wall of the overlapped back wall panels has a finger hole at the upper terminus of its vertical axis.

5. The carton of claim 1, in which tabs are formed on the bottom ends of the side panels to provide a stable footing for the carton.

* * * * *